US006124666A

United States Patent [19]

Saito et al.

[11] Patent Number: 6,124,666

[45] **Date of Patent: *Sep. 26, 2000**

[54] ELECTRON TUBE CATHODE

[75] Inventors: Masato Saito; Hiroyuki Teramoto; Takuya Ohira, all of Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/979,566

[22] Filed: Nov. 26, 1997

[30] Foreign Application Priority Data

Nov. 29, 1996 [JP] Japan ..... 8-319748

[51] Int. Cl.[7] ..... H01J 1/14

[52] U.S. Cl. ..... 313/346 R; 313/346 DC; 313/311; 313/341

[58] Field of Search ..... 313/346 R, 346 DC, 313/311, 345, 341, 310

[56] References Cited

U.S. PATENT DOCUMENTS

| | | | |
|---|---|---|---|
| 4,291,252 | 9/1981 | Aida et al. . | |
| 4,446,404 | 5/1984 | Kumada et al. | 313/346 R |
| 4,636,681 | 1/1987 | Misumi | 313/346 R |
| 4,881,009 | 11/1989 | Passmore | 313/631 |
| 4,924,137 | 5/1990 | Watanabe et al. . | |
| 4,980,603 | 12/1990 | Kimura et al. | 313/346 R |
| 5,075,589 | 12/1991 | Derks et al. | 313/346 DC |
| 5,118,984 | 6/1992 | Saito et al. . | |
| 5,519,280 | 5/1996 | Shon et al. . | |
| 5,808,404 | 9/1998 | Koizumi et al. | 313/346 R |

FOREIGN PATENT DOCUMENTS

| | | |
|---|---|---|
| 0330355 | 8/1989 | European Pat. Off. . |
| 0445956 | 9/1991 | European Pat. Off. . |
| 0445956A2 | 9/1991 | European Pat. Off. . |
| 0869527A1 | 10/1998 | European Pat. Off. . |
| 5-291358 | 8/1977 | Japan . |
| 5-825034 | 2/1983 | Japan . |
| 6-222347 | 1/1987 | Japan . |
| 63-131428 | 6/1988 | Japan . |
| 1-267926 | 10/1989 | Japan . |
| 7-87072 | 10/1989 | Japan . |
| 3-257735 | 11/1991 | Japan . |
| 4-220924 | 8/1992 | Japan . |
| 4-220925 | 8/1992 | Japan . |
| 4-220926 | 8/1992 | Japan . |
| 9-180623 | 7/1997 | Japan . |
| 9-190761 | 7/1997 | Japan . |

OTHER PUBLICATIONS

English language translation of Chinese Office Action.

*Primary Examiner*—Nimeshkumar D. Patel
*Assistant Examiner*—Michael J. Smith

[57] ABSTRACT

An electron tube cathode comprises a base (1) formed mainly of nickel, an alloy layer (4) disposed on the base (1) and including nickel and tungsten having a grain size smaller than that of the base, and an electron emissive material layer (5) deposited on the alloy layer, and including an oxide (6) of an alkaline-earth metal containing at least barium, and a rare earth metal oxide (7) of 0.01 to 25 weight percent and containing at least one of scandium oxide and yttrium oxide. The cathode has a life characteristics improved compared with the prior art, even if operated with a current density of 3 A/cm$^2$ or more.

8 Claims, 6 Drawing Sheets

ELECTRON TUBE CATHODE

BACKGROUND OF THE INVENTION

The present invention relates to an improvement of an electron tube cathode used for a cathode ray tube for television, or the like, and in particular to an electron tube cathode having an electron emissive material layer containing a rare earth metal oxide, or a heat-resistant oxide as a substitute of the rare-earth metal oxide.

FIG. 9 shows an electron tube cathode used in a cathode ray tube or image pick-up tube for television, disclosed for example in Japanese Patent Kokoku Publication No. S64-5417. In the drawing, reference numeral 111 denotes a base formed mainly of nickel and containing a small amount of silicon (Si), magnesium (Mg) or like reducing element. Reference numeral 112 denotes a cathode sleeve formed of Nichrome™ or the like. Reference numeral 115 denotes an electron emissive material layer deposited on the upper surface of the base 111, and containing, as a main constituent, an alkaline-earth metal oxide 121 containing at least barium (Ba), and additionally strontium (Sr) and/or calcium (Ca), and containing a rare earth metal oxide 122 such as scandium oxide of 0.1 to 20 weight percent. Reference numeral 113 denotes a heater disposed in the base 111. The heater 113 heats the electron emissive material layer 115 to emit thermoelectrons.

With the electron tube cathode of the above configuration, the manner of depositing the electron emissive material layer 115 onto the base 111 will next be described. First, a ternary carbonate of barium, strontium, and calcium, and a predetermined amount of scandium oxide are mixed together with a binder and a solvent, to form a suspension. The suspension is sprayed onto the base 111 to a thickness of about 80 $\mu$m, and is thereafter heated by the heater 113 during evacuation process of the cathode ray tube. The carbonate of the alkaline-earth metal is converted into alkaline-earth metal oxide. Part of the alkaline-earth metal oxide is reduced and activated to have a semiconducting property, so that the electron emissive material layer 115 consisting of the mixture of the alkaline-earth metal oxide 121 and the rare earth metal oxide 122 is formed on the base 111.

In the activation step, part of the alkaline-earth metal oxide reacts in the following manner. That is, silicon, magnesium and like reducing elements contained in the base 111 move to the interface between the alkaline earth metal oxide 121 and the base 111 by diffusion, and reacts with the alkaline earth metal oxide. For instance, if the alkaline-earth metal oxide is barium oxide, the following reactions (1) and (2) take place:

$$2BaO+(1/2)Si=Ba+(1/2)Ba_2SiO_4 \quad (1)$$

$$BaO+Mg=Ba+MgO \quad (2)$$

As a result of these reactions, part of the alkaline-earth metal oxide 121 deposited on the base 111 is reduced, to become an oxygen-deficient semiconductor, so that electron emission is facilitated. If no rare earth metal oxide is contained in the electron emissive material layer, operation with a current density of 0.5 to 0.8 A/cm$^2$, at a cathode temperature of 700 to 800° C. is possible. If a rare earth metal oxide is contained in the electron emissive material layer, operation with a current density of 1.32 to 2.64 A/cm$^2$ is possible.

Generally, electron emission performance of oxide cathodes depends on the amount of excessive Ba in the oxide. If no rare earth metal oxide is contained, excessive Ba sufficient for a high current operation cannot be supplied, and the current density at which the cathode is operable is small. That is, magnesium oxide (MgO) or barium silicate ($Ba_2SiO_4$) which is a by-product generated at the time of the above reaction, and called an intermediate layer is formed, being concentrated on nickel grain interfaces in the base 111 or the interface between the base 111 and the electron emissive material layer 115, so that the rate of the reactions expressed by formulae (1) and (2) above is controlled by the rate of the diffusion of magnesium and silicon in the intermediate layer, and supply of excessive Ba is insufficient.

If a rare earth metal oxide is contained in the electron emissive material layer, the operation is as follows. The following description is made taking scandium oxide ($Sc_2O_3$) as an example. During operation of the cathode, at the interface between the base 111 and the electron emissive material layer 115, part of the reducing agent having moved by diffusion through the base 111 reacts with scandium oxide ($Sc_2O_3$) in the manner described by the following formula (3), and a small amount of metallic scandium is generated, and part of the metallic scandium forms a solid solution with nickel in the base 111, and a part is retained at the interfaces.

$$(1/2)Sc_2O_3+(3/2)Mg=Sc+(3/2)MgO \quad (3)$$

The metallic scandium generated by the reaction of the formula (3) decomposes the above-mentioned intermediate layer formed on the base 111 or at the nickel grain interfaces in the base 111 in the manner described by the following formula (4), so that supply of excessive Ba is improved, and the rare earth metal oxide in the electron emissive material layer restrains evaporation of excessive Ba, with the result that operation is possible at a higher current density than if no rare earth metal oxide is contained.

$$(1/2)Ba_2SiO_4+(4/3)Sc=Ba+(1/2)Si+(2/3)Sc_2O_3 \quad (4)$$

Japanese Patent Kokai Publication No. S52-91358 discloses a direct-heated cathode having a base formed of a Ni alloy containing a high-melting point metal such as W or Mo which increases the mechanical strength, and a reducing agent such as Mg, Al, Si or Zr, and an alloy layer of Ni-W, or Ni-Mo coated on the surface of the base where an electron emissive material layer is to be deposited.

With the electron tube cathode formed in the described above, the rare earth metal oxide improves the supply of excessive Ba, but the rate of supply of the excessive Ba is controlled by the rate of diffusion of the reducing agent in nickel in the base, and the life characteristic at a high-current density operation of 2 A/cm$^2$ or more is substantially low.

The latter one of those mentioned above provides an improvement in respect of the thermal deformation which is a problem inherent to the direct-heated cathode emitting thermoelectrons from the electron emissive material layer, utilizing heat generated by the current through the base itself, by coating the base with a layer of an alloy such as Ni-W or Ni-Mo. However, it does not enable operation at a high current density.

With regard to these problems, the assignee of the present application already disclosed in Japanese Patent Application No. H2-56855 (Japanese Patent Kokai Publication No. H3-257735) that it is possible to improve the life characteristics with operation at a high current density of 2 A/cm$^2$, by diffusion into the base from a metal layer provided between the base and the electron emissive material layer. FIG. 10 shows the configuration of such a cathode.

SUMMARY OF THE INVENTION

The present invention has been made in an attempt to further improve the life characteristics with operation at a high current density, and it provides an improvement in respect of the life characteristics with operation at a high current density of 3 A/cm$^2$ or more, by defining the state of distribution of the metal layer within the base formed mainly of nickel, or on the surface of the base.

According to the invention, there is provided an electron tube cathode comprising:

a base formed mainly of nickel, and including at least one kind of reducing agent;

an alloy layer disposed on the base or as a surface layer of the base, and including at least one metal selected from a group consisting of tungsten, molybdenum and tantalum, and nickel; and an electron emissive material layer formed on the alloy layer, and including an oxide of an alkaline-earth metal containing at least barium, and a rare earth metal oxide of 0.01 to 25 weight percent.

Preferably, the concentration of at least one metal selected from a group consisting of tungsten, molybdenum and tantalum in the alloy layer is higher toward the electron emissive material layer.

Preferably, the alloy layer is formed of grains, and the grains are smaller than the grains forming the base.

Preferably, the thickness of the alloy layer is not less than 1 $\mu$m.

According to another aspect of the invention, there is provided an electron tube cathode comprising:

a base formed mainly of nickel, and including at least one kind of reducing agent;

a film disposed on at least part of the surface of the base, and including at least one metal selected from a group consisting of tungsten, molybdenum and tantalum; and an electron emissive material layer formed on said film, and including an oxide of an alkaline-earth metal containing at least barium, and a rare earth metal oxide of 0.01 to 25 weight percent.

It may be so arranged that said film comprises a mixture film disposed on the base, and including at least one metal selected from a group consisting of tungsten, molybdenum and tantalum, as well as nickel, or a multi-layer film including one or more single-material films of said at least one metal, and a nickel single-material film.

It may alternatively be so arranged that said film comprises a metal layer disposed on part of the surface of the base, and including said at least one metal selected from a group consisting of tungsten, molybdenum and tantalum.

Preferably, the film is formed substantially in the center of the base, and covers 12 to 80% of the surface area of the base.

It may be so arranged that said film comprises a metal layer disposed on part of the surface of the base, and including said at least one metal selected from a group consisting of tungsten, molybdenum and tantalum, and the thickness of the metal layer is 0.1 to 1.8 $\mu$m.

According to another aspect of the invention, there is provided an electron tube cathode comprising a base formed mainly of nickel, and including at least one kind of reducing agent, an alloy layer disposed on the base or as a surface layer of the base, and including at least one metal selected from a group consisting of tungsten, molybdenum and tantalum, as well as nickel, the concentration of said at least one metal selected from a group consisting of tungsten, molybdenum and tantalum in the alloy layer being higher toward the electron emissive material layer, and an electron emissive material layer formed on the alloy layer, and including at least one oxide selected from a group consisting of those of aluminum, titanium, silicon, magnesium, chromium, zirconium, hafnium, indium, and tin of 0.01 to 20 weight percent.

With the above arrangement, in addition to the reducing agent in the base, the alloy layer contributes to the supply of excessive Ba, and the alloy layer serves to ensure the stable supply of the reducing agent at the interface. Accordingly, it is possible to provide an electron tube cathode which can operate at a high current density of 3 A/cm$^2$ which was difficult to achieve with the prior art oxide cathodes, and to realize a cathode ray tube with a high brightness and high definition.

Moreover, compared with the prior art, the only increase is the step of forming the metal layer, such as tungsten, as an alloy layer, and the layer can be formed in such a manner as to reduce the residual stress. Accordingly, a cathode ray tube with an improved preciseness can be obtained at a low cost.

BRIEF DESCRIPTION OF THE DRAWINGS

FIG. 7(*d*) is a schematic sectional view of a base and a sleeve;

DETAILED DESCRIPTION OF THE PREFERRED EMBODIMENTS

Embodiment 1

Figure 1:
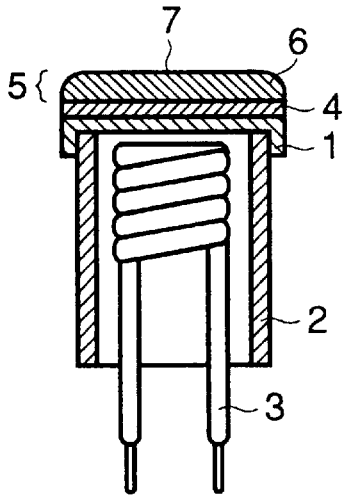
FIG. 1 is a cross sectional view of an electron tube cathode according to Embodiment 1 of the invention.

An embodiment of the invention will now be described with reference to FIG. 1. In the drawing, reference numeral 4 denotes an alloy layer formed on the top surface of a base 1, and containing nickel and at least one metal selected from the group consisting of tungsten, molybdenum and tantalum. Reference numeral 5 denotes an electron emissive material layer deposited on the alloy layer 4, and containing an alkaline-earth metal oxide 6 as a main component containing at least barium (Ba), and additionally strontium (Sr) and/or calcium (Ca), and containing a rare earth metal oxide 7 such as scandium scandium oxide, yttrium oxide or europium oxide of 0.01 to 25 weight percent.

Figure 9:
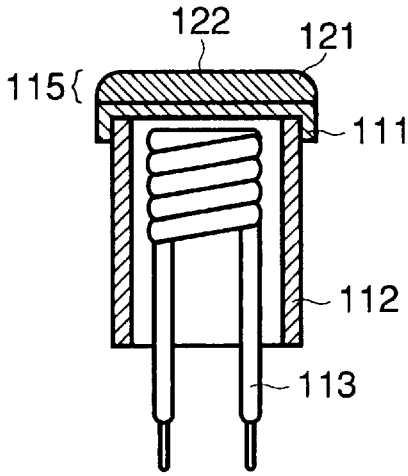
FIG.9 PRIOR ART
FIG. 9 is a sectional view showing the configuration of an electron tube cathode in the prior art.
Figure 10:
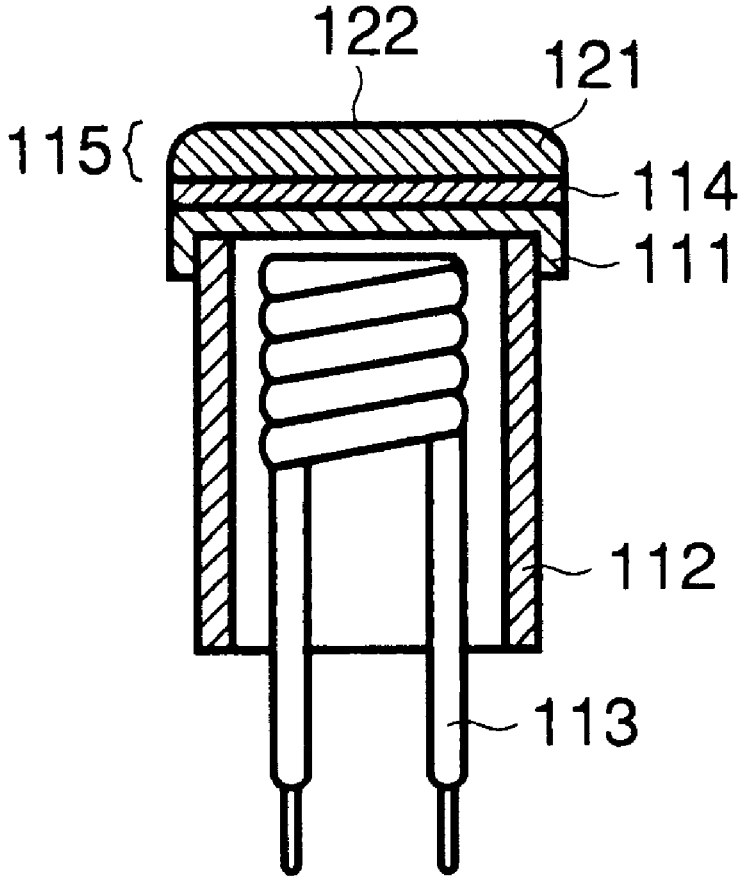
FIG.10 PRIOR ART
FIG. 10 is a sectional view showing the configuration of another electron tube cathode in the prior art.

The base 1, a sleeve 2 and a heater 3 are identical to the base 111, the sleeve 112, and the heater 113 shown in and described in connection with FIG. 9.

An example of method of fabricating an electron tube cathode configured as described above will now be described. First, a Ni base 1 containing a small amount of Si and Mg is welded to a cathode sleeve 2, and the cathode base unit is then placed in an electron beam evaporation apparatus, and tungsten (W), for example, is deposited by deposited by electron beam heating evaporation in a vacuum atmosphere of $10^{-5}$ to $10^{-8}$ Torr. The cathode base unit is then heated, for example, in a hydrogen atmosphere at 800 to 1100° C. This is to remove impurities such as oxygen remaining within or on the surface of the W metal layer, and to cause sintering of the metal layer, or re-crystallization of the metal layer, or diffusion of the metal layer into the base 1. In this method, the electron emissive material layer 5 is formed on the cathode base unit with the alloy layer 4 formed thereon, as in the prior art example.

Figure 2:
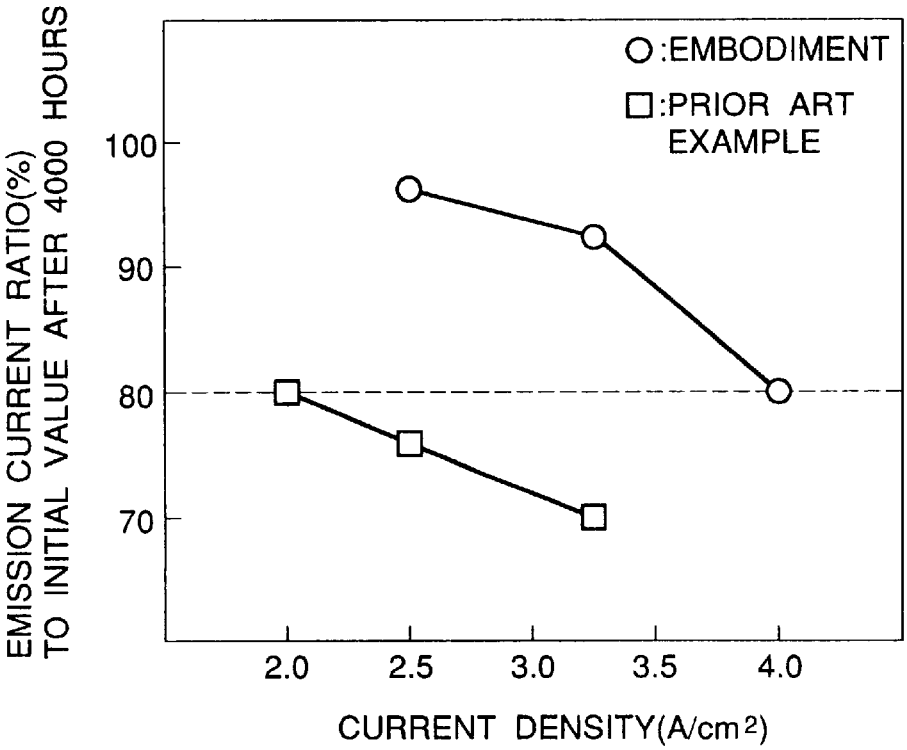
FIG. 2 is a characteristic diagram showing the relationship between the emission current ratio after a certain time (4,000 hours) of use and the current density of an electron tube cathode according to Embodiment 1 of the invention.

FIG. 2 shows the life characteristics of the electron tube cathode, that is, the emission current ratio (with respect to the initial value), in relation to the current density used, according to the embodiment, fabricated In the above-described manner, and mounted on a cathode ray tube for an ordinary television set, with the cathode ray tube being completed by normal evacuation, with the electron tube cathode being used in operation at a current density of 2 to 4 A/cm$^2$. The life characteristics is shown in comparison with a prior art example. A W film of a thickness of 0.7 $\mu$m was formed, and is heated at 1,000° C. in a hydrogen atmosphere. As the electron emissive material layer 5, an alkaline-earth metal oxide 6 containing scandium oxide of 5 weight percent was used both for the present embodiment and for the prior art example, for the purpose of comparison. As will be seen from FIG. 2, the specimen according to the present embodiment exhibits a substantially smaller emission deterioration during life compared with the prior art example.

Figure 3:
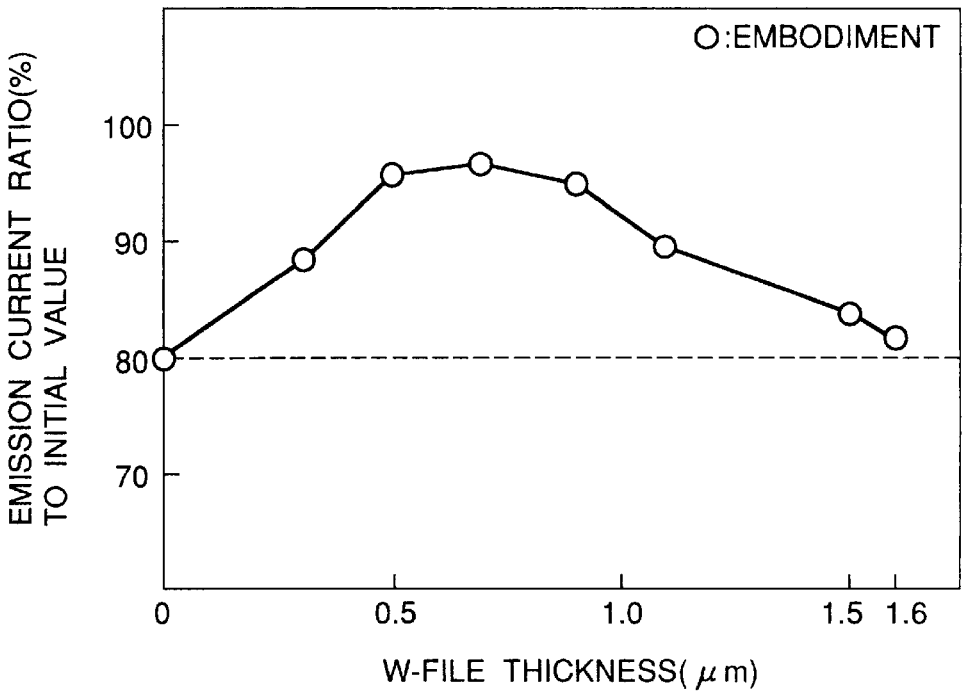
FIG. 3 is a diagram showing the relationship between the emission current ratio after a certain time (4,000 hours) of use and the film thickness of tungsten of an electron tube cathode according to Embodiment 1 of the invention.

FIG. 3 shows the life characteristics, that is, the emission current ratio (with respect to the initial value), of the electron tube cathode being used in operation at a current density of 2 A/cm$^2$, for different thicknesses of W film, the cathode being mounted in a cathode ray tube. From the results shown, it is seen that the life characteristics were improved if the W film was of a thickness of 0.1 to 1.6 $\mu$m, and remarkable improvement was gained if the W film was of a thickness of 0.3 to 1.1 $\mu$m. This is because optimum composition of nickel and tungsten is realized with this thickness, and the above-described effect is obtained stably due to the size reduction of the grains of the alloy layer.

Figure 4:
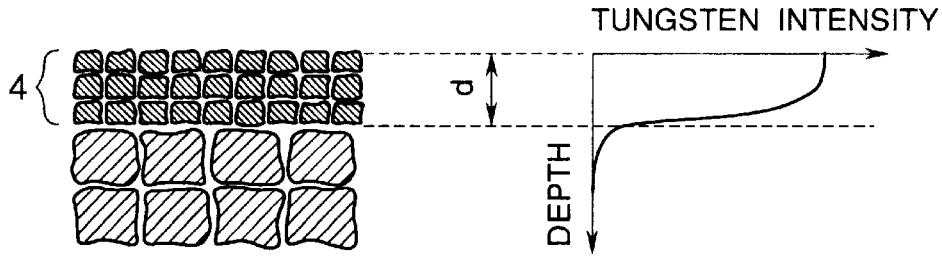
FIG. 4 is a schematic sectional view showing the distribution of tungsten in an electron tube cathode according to Embodiment 1 of the invention.

FIG. 4 shows in cross section the configuration of the cathode having a W film of 0.7 $\mu$m, after operation of 4,000 hours, and the intensity of the X-ray corresponding to the concentration of tungsten with respect to the depth, representing the distribution of tungsten in the base, obtained by the use of an X-ray micro-analyzer. The thickness d in the alloy layer indicates the depth of a part where the intensity is not less than 5% of the maximum intensity. In the drawing, the thickness d of the alloy layer and the depth of the part where the grains are small are shown to be identical, for simplicity of illustration. In many actual cases, the layer with small grains within the alloy layer is only at a part of the alloy layer shallower than the depth d, and the grain size gradually approaches the grain size in the nickel base with the increasing depth. If d is not less than 1 $\mu$m, the substantial increase in the life, compared with the prior art example, was observed as shown in FIG. 3. The region of the thickness d is an alloy layer of nickel and tungsten, and may be in the form of at least one of solid solution, eutectic (eutectic mixture), and compound (intermetallic compound).

Figure 5A:
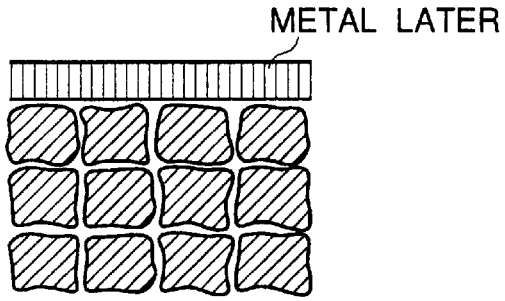
FIG. 5(*a*) and FIG. 5(*b*) are schematic sectional views of an electron tube cathode according to Embodiment 1 of the invention, showing the grains forming the respective layers.
Figure 5B:
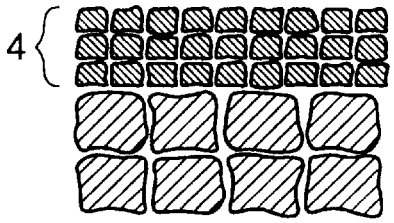

FIG. 5 shows in cross section the configuration of the cathode immediately after the formation of the metal layer, at (*a*), and after the heating step, at (*b*). It illustrates schematically the configuration as observed by a microscope. After the heating, the nickel-tungsten alloy layer extends to the depth d shown in FIG. 4, and the grains forming this layer are smaller in average size (the grains are finer) than the grains forming the base.

Figure 6A:
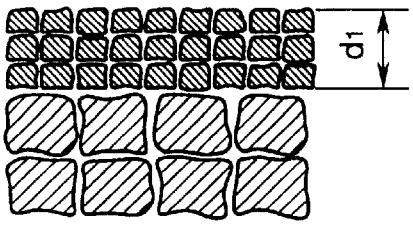
FIG. 6(*a*) and FIG. 6(*b*) are schematic sectional views of an electron tube cathode according to Embodiment 1 of the invention, showing the grains forming the respective layers, and showing changes with the progress of the heat treatment.
Figure 6B:
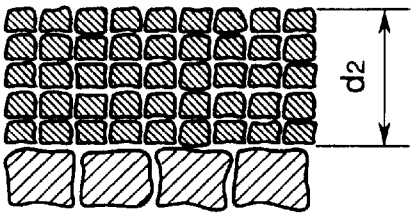
Figure 6B:
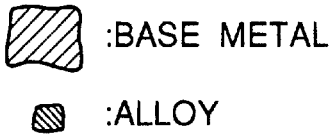
Figure 7A:
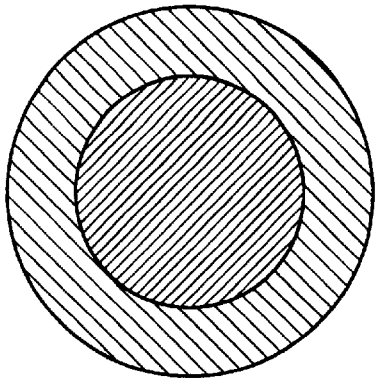
FIG. 7(*a*) to FIG. 7(*c*) are diagrams showing patterns of the tungsten film formed during manufacture of an electron tube cathode according to Embodiment 3.
Figure 7B:
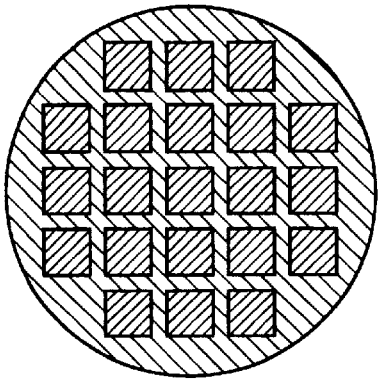
Figure 7C:
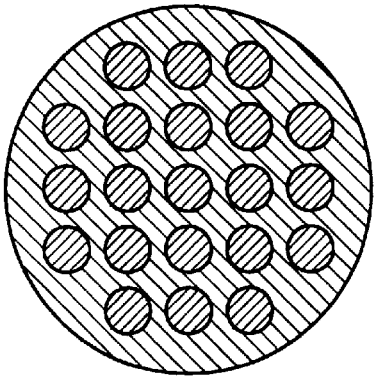
Figure 7D:
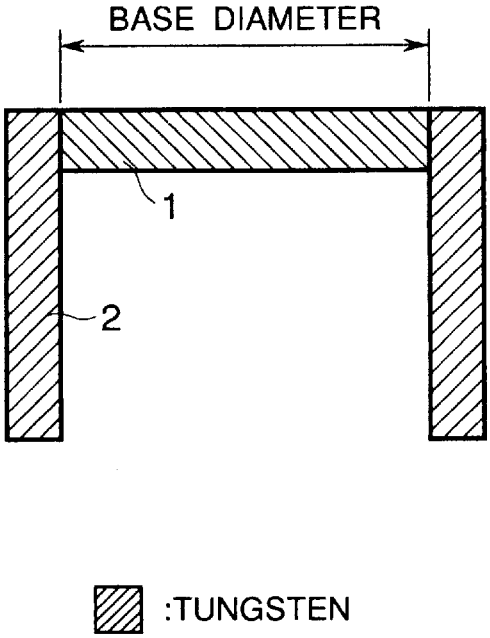

FIG. 6 schematically shows in cross section the configuration of the cathode used for the life test, being mounted in the cathode ray tube, as was described in connection with FIG. 2. In FIG. 6, (*a*) shows the cathode corresponding to (*b*) in FIG. 5, i.e., after the heating step. FIG. 6(*b*) shows the cathode after the test of FIG. 2, i.e., having experienced heat cycles. Because of the heat cycles experienced, tungsten distribution proceeds to a deeper part, and the thickness of the layer with fine grains of nickel and tungsten alloy is increased. That is, the thickness d1 before the heat cycles is increased to the thickness d2. The thickness of the part where tungsten is present reaches 10 to 20 $\mu$m, and such a distribution has been found to contribute substantially to the improvement of the life characteristics. When d1 was less than 1 $\mu$m, no sufficient improvement in the life characteristics was observed.

The improvement in the life characteristics was achieved because of the tungsten distribution or of the small grains of nickel-tungsten alloy layer, which have the following function.

First, the principle is explained in detail. In the cathode embodying the invention, the alloy layer with fine grains is formed on the surface of, or as a surface layer of the nickel base, and Mg or Si which are reducing agents diffuse through the grain interfaces in the alloy layer, and reacts with BaO at the interface between the alloy layer and the electron emissive material layer to form excessive Ba. Part of W in the alloy layer contributes to the generation of excessive Ba according to the formula (5) set forth below. Accordingly, in the initial stage of activation in which diffusion of Mg and Si, which are reducing agents, is insufficient, reduction by W on the electron emissive material side contributes. After the activation, Mg and Si, which have a greater reducing performance and which have moved sufficiently to the interface between the alloy layer and the electron emissive layer, play a major role in generating the excessive Ba. Accordingly, the intermediate layer is generated in the vicinity of the outer surface of the fine grains of the alloy layer, but as the grains of the alloy layer are fine, the rate of diffusion of Mg and Si is not controlled by the intermediate layer. Part of the intermediate layer is decomposed by the action of the rare earth metal oxide, such as scandium oxide as in the prior art. However, if the rare earth metal oxide which is simply dispersion mixed in the electron emissive material layer, as in the prior art example, the effect of decomposing the intermediate layer originates from the reaction between the scandium oxide and the reducing agent, and is therefore restricted by the limit of the solid-phase reaction, and the operating current density is limited within 2 A/cm$^2$. According to the invention, sufficient supply of excessive Ba is ensured, and the reduction of consumption of the electron emissive material layer under a high current density due to the improvement in the conductivity, and the effect of restraining evaporation of excessive Ba by the rare earth metal oxide, such as scandium oxide in the electron emissive material layer are also obtained. As a result of the combination of these effects, a high current density operation of 3 A/cm$^2$ is enabled.

$$2BaO+(1/3)W=Ba+(1/3)Ba_2WO_3 \quad (5)$$

Moreover, W has a smaller reducing property than Si and Mg which are reducing agents of the base 1, but is distributed on Ni grains or within the grains, so that reaction with scandium oxide in the electron emitting occurs relatively easily, and contributes to the generation of Sc having the effect of decomposing the intermediate layer.

In the above embodiment, W is used for the metal layer. It is desirable that the metal layer 4 has a reducing property which is not greater than at least one of the reducing agents in the base 1, and has a reducing property larger than Ni. The reason is that if the reducing property of the metal layer is smaller than Ni, the effect of supplying excessive Ba is small, while if it is larger than the reducing property of the reducing agent in the base 1, the reaction for supplying excessive Ba mainly takes place at the interface between the metal layer and the electron emissive material layer 5, the effect of supplying excessive Ba by the reducing agent in the base 1 becomes smaller, and the contribution by scandium oxide to the decomposition of the intermediate layer becomes smaller.

The material for the metal layer depends on the reducing agent in the base 1, but at least one of W, Mo, Ta and the like may be selected. The material for the metal layer may alternatively be formed of an alloy consisting of a metal, such as W, Mo or Ta, having a reducing property not more than at least one of the reducing agents in the base 1 and more than Ni, and a metal, such as Ni, having a reducing property not greater than Ni. In this case, too, if the film thickness is like that explained in connection with W, an alloy layer having fine grains can be formed, and similar effects can be obtained.

The base 1 having a metal layer of W, for example, is subject to heat treatment at a maximum temperature of 800 to 1100° C., in vacuum or in a reducing atmosphere. By this heat treatment, it is possible to control the metal layer to be distributed mainly on Ni grain in the base 1 or within the grains, and the diffusion of the reducing agents in the base 1 into the electron emissive material layer 5 can be maintained appropriately.

Distributing the coexistent layer of nickel and tungsten on the surface of the base, that is, distributing tungsten to a thickness of 1 $\mu$m or more, and making the grain size of the coexistent layer smaller than in the base, operation at a high current density of 3 A/cm$^2$ or more and improvement in the life characteristics have been achieved.

Embodiment 2

In Embodiment 1, electron beam evaporation-deposition is used to deposit tungsten constituting the metal layer. Any other method, such as sputtering, ion-beam evaporation-deposition, CVD (chemical vapor deposition), plating, ion implantation, or the like may be used, as long as a metal layer of at least one of tungsten, molybdenum and tantalum can be formed.

Embodiment 3

In the method described in connection with the above embodiments, a metal layer is formed on the base. A mixture film containing at least one metal selected from a group consisting of tungsten, molybdenum and tantalum, as well as nickel, or a multi-layer film containing one or more single-material films of the above-mentioned at least one metal, and a nickel single-material film may be formed using the methods described in connection with Embodiments 1 and 2. In such a case, the residual stress can be alleviated. Generation of stress during cathode fabrication can be reduced, and accuracy can be improved.

Embodiment 4

In the above embodiments, tungsten constituting the metal layer is simply evaporation-deposited. It is not necessary for tungsten to be formed uniformly. If the distribution of tungsten defined above can be realized by the heat treatment, the distribution immediately after the deposition may be such that tungsten is formed only at part of the base surface.

For this purpose, evaporation-deposition or the like described in connection with Embodiments 1 and 2 may be used. If a mask or the like is used at the time of the deposition of the metal layer, patterned layers as shown in FIG. 7(*a*) to FIG. 7(*c*) can be obtained.

FIG. 7(*a*) shows a case where the layer is disk-shaped, occupying only the central part of the surface of the base.

FIG. 7(*b*) shows a case where the layer is formed of a matrix of square islands provided at a pitch of 400 $\mu$m, the length of each side being 200 $\mu$m.

FIG. 7(*c*) shows a case where the layer is formed of a matrix of small disk-shaped islands provided at a pitch of 400 $\mu$m, the diameter of each small disk-shaped island being 200 $\mu$m.

In this case, the residual stress in the tungsten layer can be reduced, compared with the case of a uniform layer, and a cathode with a smaller stress and higher accuracy can be formed. In particular, if the diameter of the circular aperture (or the length of a shorter side of a rectangular aperture) of a first grid (which is disposed above, as seen in FIG. 1, is separated from the cathode, has a function of limiting the electron emitting area of the cathode, and is usually in the form of a metal plate having a circular aperture or a rectangular aperture) is not more than 0.5 mm, the variation of the cut-off voltage mentioned above results from the residual stress, leading to deterioration in the brightness characteristics and color balance.

Figure 8:
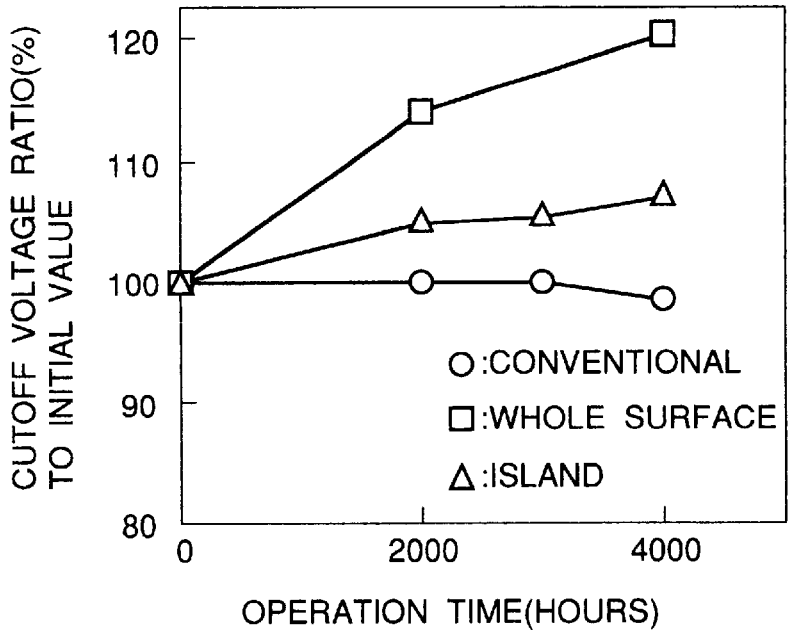
FIG. 8 is a diagram showing the variation of the cut-off voltage ratio with time exhibiting the effect of Embodiment 5 according to the invention.

FIG. 8 shows the effect of the patterned layers. In the drawing, "CONVENTIONAL" means the conventional cathode having scandium oxide dispersed in the electron emissive material layer at a concentration of 5%. "WHOLE SURFACE" means the cathode with a W film having a thickness of 0.7 $\mu$m, and formed throughout the surface of the base. "ISLAND" means the cathode with a W layer having a thickness of 0.5 $\mu$m, and a pattern shown in FIG. 7(*b*), the layer being formed of a matrix of square islands provided at a pitch of 400 $\mu$m, the length of each side being 200 $\mu$m. The effect of reduction in the residual stress is remarkable. In particular, if the patterned layer covers 12 to 80% of the central part of the surface part of the base (with the diameter indicated as "BASE DIAMETER" in FIG. 7(*d*), the reduction of the residual stress can be realized. If the thickness of the layer is 0.1 to 1.8 μm, the stress can be alleviated. If the thickness of the layer is 0.3 to 0.9 μm, improvement in the stress alleviation and in the life characteristics are both remarkable.

In the above embodiment, W is formed on a part of the base surface. A layer of at least one metal selected from the group consisting of tungsten, molybdenum and tantalum may be used. In addition, as was exemplified in connection with Embodiment 3, a mixture film containing at least one metal selected from the group consisting of tungsten, molybdenum and tantalum, as well as nickel, or a multi-layer film containing one or more single-material films of the above-mentioned at least one metal and a nickel single-material film may be formed on part on the base surface.

Embodiment 5

In the above embodiment, the rare earth metal oxide is dispersed in the electron emissive material layer. Instead of a rare earth metal oxide, the electron emissive material layer may be formed of an alkaline earth metal oxide containing at least barium, and at least one oxide selected from a group consisting of those of aluminum (Al), titanium (Ti), silicon (Si), magnesium (Mg), chromium (Cr), zirconium (Zr), hafnium (Hf), indium (In), and tin (Sn) of 0.01 to 20 weight percent, and yet a high current density can be realized because of the effects of the alloy layer mentioned above, although the effect is a little smaller than if the rare earth metal oxide is used. In this case, there is an advantage in terms of cost.

An electron tube cathode embodying the invention can be used in a television cathode ray tube, or television image pick-up tube. By using it in a cathode ray tube for a projection television or a large-sized television, and having it operate at a high current, a high brightness can be achieved. In particular, it is useful for achieving a high brightness in a cathode ray tube for high-definition television. Also, by using it in a cathode ray tube in a display monitor and operating it at a high current density, the area from which the current is drawn is reduced, and the definition of the cathode ray tube can be improved.

What is claimed is:

1. An electron tube cathode comprising:

a base formed mainly of nickel, and including at least one kind of reducing agent;

an alloy layer disposed on the base or as a surface layer of the base, and including at least one metal selected from a group consisting of tungsten, molybdenum and tantalum, and nickel; and an electron emissive material layer formed on said alloy layer, and including an oxide of an alkaline-earth metal containing at least barium, and a rare earth metal oxide of 0.01 to 25 weight percent;

wherein said film is formed substantially in the center of the base, and covers 12 to 80% of the surface area of the base.

2. The electron tube cathode as set forth in claim 1, wherein a thickness of the alloy layer is not less than 1 μm.

3. An electron tube cathode comprising:

a base formed mainly of nickel, and including at least one kind of reducing agent;

a film disposed at least part of the surface of the base, and including at least one metal selected from a group consisting of tungsten, molybdenum and tantalum; and an electron emissive material layer formed on said film, and including an oxide of an alkaline-earth metal containing at least barium, and a rare earth metal oxide of 0.01 to 25 weight percent;

wherein said film is formed substantially in the center of the base, and covers 12 to 80% of the surface area of the base.

4. The electron tube cathode as set forth in claim 1, wherein said alloy layer comprises a mixture film disposed on the base, and including at least one metal selected from a group consisting of tungsten, molybdenum and tantalum, as well as nickel, or a multi-layer film including one or more single-material films of said at least one metal, and a nickel single-material film.

5. The electron tube cathode as set forth in claim 3, wherein said film comprises a metal layer; and the thickness of said metal layer is 0.1 to 1.8 μm.

6. An electron tube cathode comprising:

a base formed mainly of nickel, and including at least one kind of reducing agent;

an alloy layer disposed on the base or as a surface layer of the base, and including at least one metal selected from a group consisting of tungsten, molybdenum and tantalum, as well as nickel;

the concentration of said at least one metal selected from a group consisting of tungsten, molybdenum and tantalum in said alloy layer being higher toward said electron emissive material layer; and an electron emissive material layer formed on said alloy layer, and including at least one oxide selected from a group consisting of those of aluminum, titanium, silicon, magnesium, chromium, zirconium, hafnium, indium, and tin of 0.01 to 20 weight percent;

wherein said alloy layer is formed of grains, and said grains are smaller than the grains forming said base;

wherein said film is formed substantially in the center of the base, and covers 12 to 80% of the surface area of the base.

7. The electron tube cathode as set forth in claim 1, wherein the concentration of at least one metal selected from a group consisting of tungsten, molybdenum and tantalum in said alloy layer is higher toward said electron emissive material layer.

8. The electron tube cathode as set forth in claim 1, wherein said alloy layer is formed of grains, and said grains are smaller than grains forming said base.

* * * * *